US010629121B2

(12) United States Patent
Zhu et al.

(10) Patent No.: US 10,629,121 B2
(45) Date of Patent: Apr. 21, 2020

(54) ORGANIC LIGHT-EMITTING PIXEL DRIVING CIRCUIT, DRIVING METHOD THEREOF, AND ORGANIC LIGHT-EMITTING DISPLAY PANEL

(71) Applicant: Shanghai Tianma AM-OLED Co., Ltd., Shanghai (CN)

(72) Inventors: Renyuan Zhu, Shanghai (CN); Zeyuan Chen, Shanghai (CN); Gang Liu, Shanghai (CN); Yue Li, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 37 days.

(21) Appl. No.: 15/611,475

(22) Filed: Jun. 1, 2017

(65) Prior Publication Data

US 2017/0270867 A1 Sep. 21, 2017

(30) Foreign Application Priority Data

Jan. 10, 2017 (CN) ..... 2017 1 0015312

(51) Int. Cl.
*G09G 3/3233* (2016.01)

(52) U.S. Cl.
CPC ... *G09G 3/3233* (2013.01); *G09G 2300/0861* (2013.01); *G09G 2310/0251* (2013.01);
(Continued)

(58) Field of Classification Search
CPC ... G09G 2310/0262; G09G 2300/0426; G09G 3/3266; G09G 3/3258; G09G 2300/0861;
(Continued)

(56) References Cited

U.S. PATENT DOCUMENTS 9,035,976 B2 5/2015 Lee et al.
2009/0009441 A1* 1/2009 Yamamoto ..... G09G 3/3233 345/80

(Continued)

FOREIGN PATENT DOCUMENTS

CN 102034426 A 4/2011
CN 103440840 A 12/2013

(Continued)

*Primary Examiner* — Patrick N Edouard
*Assistant Examiner* — Douglas M Wilson
(74) *Attorney, Agent, or Firm* — Anova Law Group PLLC

(57) ABSTRACT

An organic light-emitting pixel driving circuit, a driving method thereof, and an organic light-emitting display panel are provided. The organic light-emitting pixel driving circuit includes a light-emitting element, a driving transistor, a first and a second initialization modules, a threshold detection module, a data write-in module, and a storage module. The driving transistor is configured to drive the light-emitting element. The first initialization module is configured to transmit a signal carried by a reference voltage line to the driving transistor. The second initialization module is configured to transmit a signal carried by an initialization signal line to the light-emitting element. The threshold detection module is configured to detect a threshold voltage of the driving transistor. The data write-in module is configured to transmit a signal carried by a data line to the pixel driving circuit. The storage module is configured to store a signal written in by the data line.

14 Claims, 10 Drawing Sheets

(52) U.S. Cl.
CPC ..... *G09G 2310/0262* (2013.01); *G09G 2320/043* (2013.01)

(58) Field of Classification Search
CPC ..... G09G 2329/043; G09G 2310/0251; G09G 3/3233
See application file for complete search history.

(56) References Cited

U.S. PATENT DOCUMENTS

| | | | | |
|---|---|---|---|---|
| 2011/0164016 | A1* | 7/2011 | Kang | G09G 3/3233 345/211 |
| 2013/0093800 | A1* | 4/2013 | Shim | G09G 3/3233 345/690 |
| 2013/0215057 | A1* | 8/2013 | Kawachi | G09G 3/3611 345/173 |
| 2013/0335399 | A1* | 12/2013 | Tsuge | G09G 3/30 345/212 |
| 2014/0022288 | A1* | 1/2014 | Tsuge | G09G 3/3233 345/690 |
| 2015/0379926 | A1* | 12/2015 | Wu | G09G 3/3225 345/215 |
| 2017/0178571 | A1* | 6/2017 | Kang | G09G 3/3258 |
| 2017/0186372 | A1* | 6/2017 | Yanase | G09G 3/3233 |
| 2018/0182289 | A1* | 6/2018 | Jung | G09G 3/3258 |

FOREIGN PATENT DOCUMENTS

| | | | |
|---|---|---|---|
| CN | 103531151 | A | 1/2014 |
| CN | 106297666 | A | 1/2017 |
| EP | 1611566 | A1 | 1/2006 |

* cited by examiner

ORGANIC LIGHT-EMITTING PIXEL DRIVING CIRCUIT, DRIVING METHOD THEREOF, AND ORGANIC LIGHT-EMITTING DISPLAY PANEL

CROSS-REFERENCES TO RELATED APPLICATIONS

This application claims priority of Chinese Patent Application No. 201710015312.3, filed on Jan. 10, 2017, the entire contents of which are hereby incorporated by reference.

FIELD OF THE DISCLOSURE

The present disclosure generally relates to the field of display technology and, more particularly, relates to an organic light-emitting pixel driving circuit, a driving method thereof, and an organic light-emitting display panel.

BACKGROUND

An organic light-emitting display panel uses an organic light-emitting element to display images. The organic light-emitting display panel has been increasingly and widely applied to various kinds of electronic devices because of advantages such as fast response and low power consumption, etc.

Often, a display panel of the organic light-emitting display device includes a plurality of pixels arranged in a matrix, and each of the plurality of pixels includes an organic light-emitting element. Accordingly, the quality of the working status of the organic light-emitting element may directly impact the evenness and brightness of the display panel. The organic light-emitting element is a current-controlled module and is often driven using a current generated by the thin film transistor that is in a saturation state. Restricted by the fabrication process, the threshold voltage |Vth| of the driving transistors, particularly the driving transistors fabricated by the low-temperature polysilicon (LTPS) technology, have very poor evenness and may even drift, such that different driving currents may be generated when the same grey-scale voltage is inputted. The inconsistency in the driving current may cause the working status of the organic light-emitting element to be unstable, thereby rendering relatively poor evenness in the display brightness of the organic light-emitting display panel.

The disclosed organic light-emitting pixel driving circuit, driving method thereof, and organic light-emitting display panel are directed to solving at least partial problems set forth above and other problems.

BRIEF SUMMARY OF THE DISCLOSURE

One aspect of the present disclosure provides an organic light-emitting pixel driving circuit. The organic light-emitting pixel driving circuit includes a light-emitting element, a driving transistor, a first and a second initialization modules, a threshold detection module, a data write-in module, and a storage module. The driving transistor is configured to drive the light-emitting element to emit light. The first initialization module is configured to transmit a signal carried by a reference voltage line to a gate electrode of the driving transistor under control of a first scanning signal line. The second initialization module is configured to transmit a signal carried by an initialization signal line to an anode of the light-emitting element to initiate the anode of the light-emitting element. The threshold detection module is configured to detect a threshold voltage of the driving transistor under control of a light-emitting control signal line. The data write-in module is configured to transmit a signal carried by a data line to the pixel driving circuit under control of a third scanning signal line. The storage module is connected between the threshold detection, module and a source electrode of the driving transistor, and configured to store a signal written in by the data line.

Another aspect of the present disclosure provides a driving method of an organic light-emitting pixel driving circuit. The organic light-emitting pixel driving circuit includes a first initialization module, a second initialization module, a threshold detection module, a data write-in module, a driving transistor, a light-emitting element, and a light-emitting control module. The driving method comprises in an initialization stage, transmitting, by the first initialization module, a signal carried by a reference voltage line to a gate electrode of the driving transistor based on a first scanning signal line, and transmitting, by the second initialization module, a signal carried by an initialization signal line to an anode of the light-emitting element based on a second scanning line, such that initialization of the driving transistor and the light-emitting element is fulfilled. The driving method further comprises in a threshold detection stage, turning on the threshold detection module based on a signal carried by a light-emitting control signal line, and transmitting, by the first initialization module, a signal carried by the reference voltage line to the gate electrode of the driving transistor based on a first scanning signal line, such that threshold detection of the driving transistor is fulfilled.

Another aspect of the present: disclosure provides a driving method of an organic light-emitting pixel driving circuit. The organic light-emitting pixel driving circuit includes a first initialization module, a second initialization module, a threshold detection module, a data write-in module, a driving transistor, a light-emitting element, and a light-emitting control module. The driving method comprises in an initialization stage, transmitting, by the first initialization module, a signal carried by a reference voltage line to a gate electrode of the driving transistor based on a first scanning signal line, and transmitting, by the second initialization module, a signal earned by an initialization signal line to an anode of the light-emitting element based on a second scanning line, such that initialization of the driving transistor and the light-emitting element is fulfilled. The driving method further comprises in a threshold detection stage, turning on the data write-in module based on the first scanning signal line to transmit a signal carried by a data line to the storage module, turning off the threshold detection module based on a light-emitting control signal line, and transmitting, by the first initialization module, a signal carried by reference voltage line to the gate electrode of the driving transistor based on the first scanning signal line, such that threshold detection of the driving transistor of the driving transistor is fulfilled.

Other aspects of the present disclosure can be understood by those skilled in the art in light of the description, the claims, and the drawings of the present disclosure.

BRIEF DESCRIPTION OF THE DRAWINGS

Other features, goals, and advantages of the present disclosure will become more apparent via a reading of detailed descriptions of non-limiting embodiments with reference to the accompanying drawings.

DETAILED DESCRIPTION

Reference will be made in detail with reference to embodiments of the present disclosure as illustrated in the accompanying drawings and embodiments. It should be understood that, specific embodiments described herein are only for illustrative purposes, and are not intended to limit the scope of the present disclosure. In addition, for ease of description, accompanying drawings only illustrate a part of, but not entire structure related to the present disclosure.

It should be noted that, when there is no conflict, disclosed, embodiments and features of the disclosed embodiments may be combined with each other. Hereinafter, the present disclosure is illustrated in detail with reference to embodiments thereof as illustrated in the accompanying drawings.

Figure 1A:
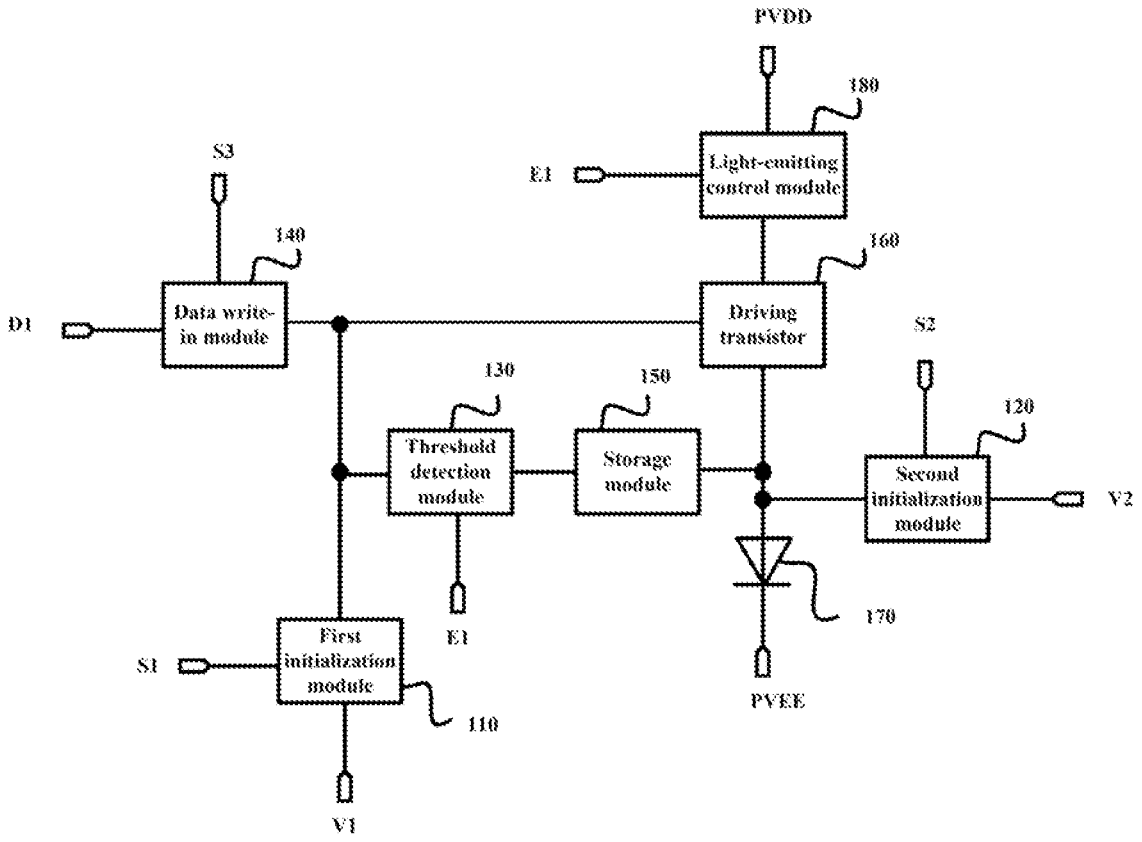
FIG. 1A illustrates a structural schematic view of an exemplary organic light-emitting pixel driving circuit according to embodiments of the present disclosure.

FIG. 1A illustrates a structural schematic view of an exemplary organic light-emitting pixel driving circuit according to embodiments of the present disclosure. As shown in FIG. 1A, an organic light-emitting pixel driving circuit may include a first initialization module 110, a second initialization module 120, a threshold detection module 130, a data write-in module 140, a storage module 150, a driving transistor 160, and a light-emitting element 170. Optionally, the organic light-emitting pixel driving circuit may further include a light-emitting control module 180.

The organic light-emitting pixel driving circuit may further include a reference voltage line V1, an initialization signal line V2, a first scanning signal line S1, a second scanning signal line S2, a third scanning signal line S3, a light-emitting control signal line E1, and a data line D1. Further, the organic light-emitting pixel driving circuit may further include a first power supply voltage end PVDD, and a second power supply voltage end PVEE.

More specifically, the first initialization module 110 may be electrically connected to the reference voltage line V1 and a gate electrode of the driving transistor 160. Based on a signal carried by the first scanning signal line S1, the first initialization module 110 may be turned on. Accordingly, the first initialization module 110 may transmit a signal carried by the reference voltage line V1 to the gate electrode of the driving transistor 160, thus initializing the driving transistor 160.

The second initialization module 120 may be electrically connected to the initialization signal line V2 and an anode of the light-emitting element 170. Based on a signal carried by the second scanning signal line S2, the second initialization module 120 may be turned on. Accordingly, the second initialization module 120 may transmit a signal carried by the initialization signal line V2 to the anode of the light-emitting element 170, thus initializing the light-emitting element 170.

The threshold detection module 130 may be electrically connected to the storage module 150, and the gate electrode of the driving transistor 160. Based on a signal carried by the light-emitting control signal line E1, a threshold voltage Vth of the driving transistor 160 may be detected.

The data write-in module 140 may be electrically connected to the data line D1. Based on a signal carried by the third scanning signal line S3, the data write-in module 140 may supply a signal (e.g., a data signal voltage) carried by the data line D1 to the disclosed pixel driving circuit.

The storage module 150 may be electrically connected between the threshold detection module 130 and a first electrode (e.g., a source electrode) of the driving transistor 160. Further, as shown in FIG. 1A, the storage module 150 may be electrically connected to the data write-in module 140 via the threshold detection module 130. Accordingly, when the threshold detection module 130 and the data write-in module 140 are turned on, the storage module 150 may be configured to store the signal (e.g., the data signal voltage) carried by the data line D1 and to compensate the threshold voltage of the driving transistor 160.

The driving transistor 160 may be configured to generate a driving current, and may include a gate electrode, a first electrode, and a second electrode. Optionally, the first electrode may be the source electrode and the second electrode may be the drain electrode. As mentioned above, the driving transistor 160 may be electrically connected to the first initialization module 110, the threshold detection module 130, and the storage module 150. Optionally, the driving transistor 160 may be further electrically connected to the light-emitting control module 180.

The light-emitting element 170 may be configured to emit light. When the light-emitting element 170 emits light, the storage module 150 may be configured to compensate the threshold voltage of the pixel driving circuit. Accordingly, the stability of the current of the light-emitting element 170 may be ensured, and the display evenness of the organic light-emitting display panel may be improved.

Optionally, when the organic light-emitting pixel driving circuit further includes a light-emitting control module 180, the light-emitting control module 180 may be electrically connected to the driving transistor 160, the light-emitting control signal line E1, and the first power supply voltage end PVDD. Based on a signal carried by the light-emitting control signal line E1, the light-emitting control module 180 may transmit a signal outputted by the first power supply voltage end PVDD to the driving transistor 160.

Further, the light-emitting control signal line E1 may be configured to control the threshold detection module 130 to be turned on, such that the threshold voltage Vth of the driving transistor 160 and the signal carried by the data line D1 may be stored in the storage module 150. Thus, when the light-emitting element 170 emits light, the storage module 150 may compensate the drift of the threshold voltage Vth of the driving transistor 160. Accordingly, the evenness and stability of the driving current may be ensured, and the display evenness of the organic light-emitting display panel may be improved.

Figure 1B:
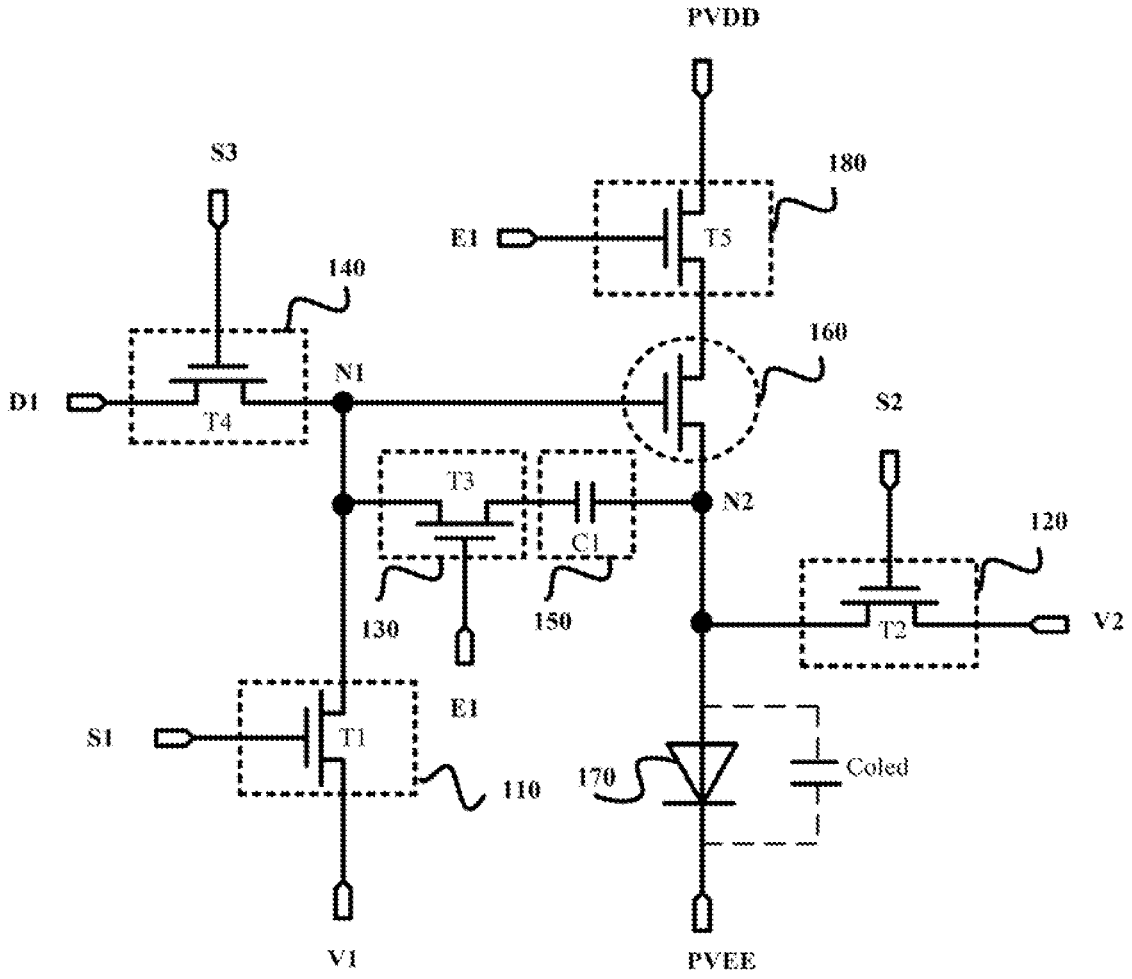
FIG. 1B illustrates an optional implementation of an organic light-emitting pixel driving circuit in FIG. 1A.

FIG. 1B illustrates an example implementation of an organic light-emitting pixel driving circuit in FIG. 1A according to embodiments of the present disclosure. As shown in FIG. 1B, similar to or the same as FIG. 1A, the organic light-emitting pixel driving circuit may include a first initialization module 110, a second initialization module 120, a threshold detection module 130, a data write-in module 140, a storage module 150, a driving transistor 160, and a light-emitting element 170. Optionally, the organic light-emitting pixel driving circuit may further include a light-emitting control module 180.

The organic light-emitting pixel driving circuit may further include a reference voltage line V1, an initialization signal line V2, a first scanning signal line S1, a second scanning signal line S2, a third scanning signal line S3, a light-emitting control signal line E1, and a data line D1. Further, the organic light-emitting pixel driving circuit may include a first power supply voltage end PVDD and a second power supply voltage end PVEE.

Further, the first initialization module 110 may include a first transistor T1, the second initialization module 120 may include a second transistor T2, the threshold detection module 130 may include a third transistor T3, the data write-in module 140 may include a fourth transistor T4, and the light-emitting control module 180 may include a fifth transistor T5. Further, the storage module 150 may include a first capacitor C1.

More specifically, a first electrode of the first transistor T1 may be electrically connected to the reference voltage line V1, a second electrode of the first transistor T1 may be electrically connected to a gate electrode of the driving transistor 160, and a gate electrode of the first transistor T1 may be electrically connected to the first scanning signal line S1. A first electrode of the second transistor T2 may be electrically connected to the initialization signal line V2, a second electrode of the second transistor T2 may be electrically connected to an anode of the light-emitting element 170, and a gate electrode of the second transistor T2 may be electrically connected to the second scanning signal line S2.

A first electrode of the third transistor T3 may be electrically connected to the gate electrode of the driving transistor 160, a second electrode of the third transistor T3 may be electrically connected to a first plate of the first capacitor C1, and a gate electrode of the third transistor T3 may be electrically connected to the light-emitting control signal line E1. A second plate of the first capacitor C1 may be electrically connected to a source electrode of the driving transistor 160.

A first electrode of the fourth transistor T4 may be electrically connected to the data line D1, a second electrode of the fourth transistor T4 may be electrically connected to the gate electrode of the driving transistor 160, and a gate electrode of the fourth transistor T4 may be electrically connected to the third scanning signal line S3. A first electrode of the fifth transistor T5 may be electrically connected to the first power supply voltage end PVDD, a second electrode of the fifth transistor T5 may be electrically connected to a drain electrode of the driving transistor 160, and a gate electrode of the fifth transistor T5 may be electrically connected to the light-emitting control signal E1.

In one embodiment, as shown in FIG. 1B, the first transistor T1, the second transistor T2, the third transistor T3, the fourth transistor T4, the fifth transistor T5, and the driving transistor 170 may be all N-type transistors (e.g., NMOS transistors). FIG. 1B illustrates such driving circuit for illustrative purposes only, and in practical applications, each of the first transistor T1, the second transistor T2, the third transistor T3, the fourth transistor T4, the fifth transistor T5, and the driving transistor 160 may be configured to be an N-type transistor (e.g., an NMOS transistor) or an P-type transistor (e.g., an PMOS transistor).

More specifically, as shown in FIG. 1B, the third transistor T3 and the first capacitor C1 may be connected between, the gate electrode and the source electrode of the driving transistor 160. The light-emitting control signal line E1 may be configured to control the third transistor T3 to be turned on, thereby detecting a threshold voltage Vth of the driving transistor 160 and storing the threshold voltage Vth in the first capacitor C1.

When the light-emitting element 170 emits light, the first capacitor C1 may be configured to allow the voltage difference between the gate electrode and the source electrode of the driving transistor 160 to be constant via the coupling effects. Accordingly, the driving current of the light-emitting element 170 may be more stable, and the display evenness of the organic light-emitting display panel may be improved.

Figure 1C:
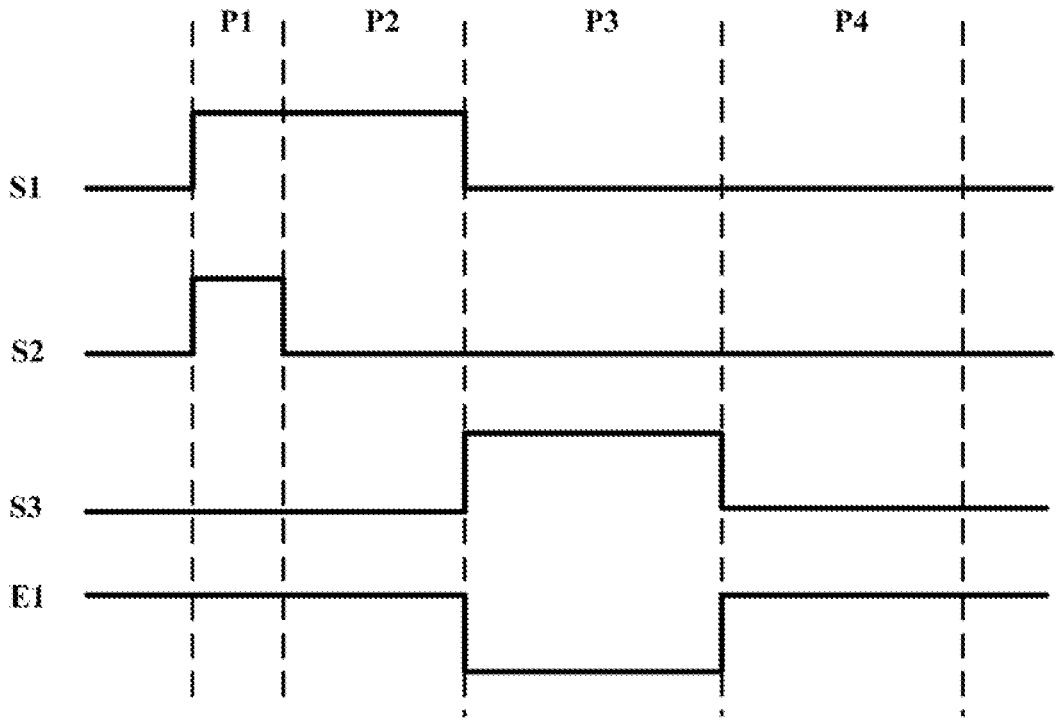
FIG. 1C illustrates an exemplary timing diagram of a timing sequence configured to drive an organic light-emitting pixel driving circuit in FIG. 1B.

For example, the first transistor T1, the second transistor T2, the third transistor T3, the fourth transistor T4, the fifth transistor T5, and the driving transistor 160 are all assumed to be N-type transistors (e.g., NMOS transistors) hereinafter for illustrative purposes. FIG. 1C illustrates an exemplary timing sequence of an organic light-emitting pixel driving circuit in FIG. 1B according to embodiments of the present disclosure. Hereinafter, the working principles of the organic light-emitting pixel driving circuit in FIG. 1B are described in detail with reference to FIG. 1C.

As shown in FIG. 1C, the timing sequence of an organic light-emitting pixel driving circuit in FIG. 1B may include a first stage P1, a second stage P2, a third stage P3, and a fourth stage P4. More specifically, in the first stage P1, a high voltage level signal may be supplied to the first scanning signal line S1, the second scanning signal line S2, and the light-emitting control signal line E1, thereby turning on the first transistor T1, the second transistor T2, the third transistor T3, and the fifth transistor T5. A low voltage level signal may be supplied to the third scanning signal line S3, thereby turning off the fourth transistor T4.

Further, in the first stage P1, a reference voltage Vref may be supplied to the reference voltage line V1, and an initialization signal voltage Vinit may be supplied to the initialization signal line V2. Because the first transistor T1 is turned on, the first transistor T1 may transmit the reference voltage Vref carried by the reference voltage line V1 to a node N1, such that the voltage level of the gate electrode of the driving transistor 160 may be equal to Vref. Accordingly, the driving transistor 160 may be turned on. In particular, the node N1 may be a node intersected by the second electrode of the first transistor T1, the first electrode of the third transistor T3, the second electrode of the fourth transistor T4, and the gate electrode of the driving transistor 160.

Further, because the second transistor T2 is turned on, the second transistor T2 may transmit the initialization signal voltage Vinit carried by the initialization signal line V2 to a node N2, such that the voltage level of the anode of the light-emitting element 170 may be equal to Vinit. The node N2 may be a node intersected by the second electrode of the second transistor T2, the anode of the light-emitting element 170, and the second plate of the first capacitor C1.

In the second stage P2, a high voltage level signal may be supplied to the first scanning signal line S1 and the light-emitting control signal line E1, thereby turning on the first transistor T1, the third transistor T3, and the fifth transistor T5. A low voltage level signal may be supplied to the second scanning signal line S2 and the third scanning signal line S3, thereby turning off the second transistor T2 and the fourth transistor T4.

Further, the reference voltage Vref may be supplied to the reference voltage line V1, and because the first transistor T1 is turned on, the first transistor T1 may transmit the reference voltage Vref to the node N1. Thus, the voltage level of the node N1 may reach Vref. That is, the voltage level Vg of the gate electrode of the driving transistor 160 may be equal to Vref. Accordingly, the driving transistor 160 may be turned on.

Further, in the second stage P2, because the fifth transistor T5 is turned on and the driving transistor 160 is turned on, a signal carried by the first power supply voltage end PVDD may raise the voltage level of the node N2 from Vinit to Vref−Vth via the driving transistor 160, By then, the driving transistor 160 may be turned off, and the voltage level Vs of the source electrode of the driving transistor 160 may be equal to Vref−Vth, where Vth is the threshold voltage of the driving transistor 160.

Thus, at the end of the second stage P2, the voltage level of the node N2 may be equal to Vref−Vth. That is, the voltage level of the anode of the light-emitting element 170 may be Vref−Vth. Because the voltage level of the cathode of the light-emitting element 170 is equal to the second power supply voltage PVEE of the second power supply voltage end PVEE, the voltage difference between the anode and cathode of the light-emitting element 170 may be equal to Vref−Vth−PVEE. Further, the voltage difference Vref−Vth−PVEE may be configured to be smaller than the threshold voltage Voled that turns on the light-emitting element 170. Accordingly, the light-emitting element 170 may not emit light.

In the third stage P3, a high voltage level signal may be supplied to the third scanning signal line S3, thereby turning on the fourth transistor T4. A low voltage level signal may be supplied to the first scanning signal line S1, the second scanning signal line S2, and the light-emitting control signal line E1, thereby turning off the first transistor T1, the second transistor T2, the third transistor T3, and the fifth transistor T5. Further, the data signal voltage Vdata may be supplied to the data signal line D1. Because the fourth transistor T4 is turned on, the data signal voltage Vdata carried by the data signal line D1 may be transmitted to the node N1.

Further, as shown in FIG. 1B, because the light-emitting element 170 includes a capacitor Coled, two plates of the capacitor Coled may be configured to be connected to two ends of the light-emitting element 170. Further, the capacitor Coled may have a bootstrap function. That is, the capacitor Coled may maintain the voltage difference between the two plates of the capacitor Coled itself to be unchanged. Further, the second power supply voltage PVEE of the cathode of the light-emitting element may remain unchanged. Accordingly, the voltage level of the node N2 may remain unchanged and be equal to Vref−Vth.

That is, in the third stage P3, the capacitor Coled included in the light-emitting element 170 may be configured to maintain the voltage level of the node N2 without introducing additional capacitor elements. Accordingly, the organic light-emitting pixel driving circuit may have a relatively simple structure, and the layout area occupied by the pixel driving circuit in the display panel may be reduced.

In the fourth stage P4, a high voltage level signal may be supplied to the light-emitting control signal line E1, thereby turning on the third transistor T3 and the filth transistor T5. A low voltage level signal may be supplied to the first scanning signal line S1, the second scanning signal line S2, and the third scanning signal line S3, thereby turning off the first-transistor T1, the second transistor T2, and the fourth transistor T4. Because the third transistor T3 is turned on, the voltage difference between the two ends of the first capacitor C1 may be equal to the voltage difference between the node N1 and the node N2. That is, the voltage difference between two ends of the first capacitor C1 may be equal to Vdata−Vref+Vth.

Further, in the fourth stage P4, because the fifth transistor T5 and the driving transistor 160 are turned on, the voltage level of the node N2 may be raised from Vref−Vth to PVEE+Voled. The light-emitting element 170 may emit light, and the voltage level of the anode of the light-emitting element 170 may be equal to PVEE+Voled. That is, the voltage level Vs of the source electrode of the driving transistor 160 may be equal to PVEE+Voled.

Because of the bootstrap function of the first capacitor C1, the voltage difference between the two ends of the first capacitor C1 may remain unchanged and be equal to Vdata−Vref+Vth. Thus, when the voltage level of the node N2 is raised from Vref−Vth to PVEE+Voled, the variance in the voltage of the second plate of the first capacitor C1 may be equal to PVEE+Voled−Vref+Vth. Accordingly, the voltage level of the first plate of the first capacitor C1 may be equal to Vdata+(PVEE+Voled−Vref+Vth). That is, the voltage level of the node N1 may be equal to PVEE+Voled+Vdata−Vref+Vth.

According to the equation of a driving current generated by a light-emitting element, the driving current Ioled that flows through the driving transistor 160 and is configured to drive the light-emitting element 170 to emit light may be proportional to the square of the voltage difference between the gate-source voltage Vgs and the threshold voltage Vth of the driving transistor 160, The gate-source voltage Vgs may refer to a voltage difference between the gate electrode and the source electrode of the driving transistor 160. Further, the gate-source voltage Vgs of the driving transistor 160 may be a voltage difference between the node N1 and the node N2. Accordingly, the driving current Ioled of the light-emitting element 170 may be:

$$Ioled \propto (Vgs-Vth)^2=(Vg-Vs-Vth)^2=((PVEE+Voled+Vdata-Vref+Vth)-(PVEE+Voled)-Vth)^2=(Vdata-Vref)^2.$$

From the equation above, the driving current Ioled of the light-emitting element 170 may not be related to the threshold voltage Vth of the driving transistor 160, and the compensation for the threshold voltage Vth of the driving transistor 160 may thus be realized.

Often, in a light-emitting display panel, different rows of pixel units may be connected to the same first power supply voltage end PVDD. Because the distances between different rows of pixel units and the first power supply voltage end PVDD are different, an issue of voltage attenuation may often exist in light-emitting display panels when the first power supply voltage end PVDD outputs the first power supply voltage PVDD to different rows of pixel units.

By using the disclosed light-emitting pixel driving circuit, the driving current Ioled of the light-emitting element 170 may not be related to the first power supply voltage PVDD outputted by the first power supply voltage end PVDD, Thus, the issue of the existence of voltage attenuation when the first power supply voltage end PVDD outputs the first power supply voltage PVDD to different rows of pixel units may be avoided. Further, the evenness of the current in the display region of the display panel may be improved, and the display effect of the display panel may be enhanced.

As shown in the equation of the driving current Ioled, when the disclosed organic light-emitting pixel, driving circuit is applied to the organic light-emitting display panel, the light-emitting current may be unrelated to the threshold voltage Vth of the driving transistor 160 and the first power supply voltage end PVDD outputted by the first power supply voltage end PVDD. Thus, the phenomenon of uneven display induced by variance in the threshold of the driving transistor 160 and the voltage attenuation of the first power supply voltage end PVDD may not occur, thereby improving the display evenness of the display panel.

Figure 2A:
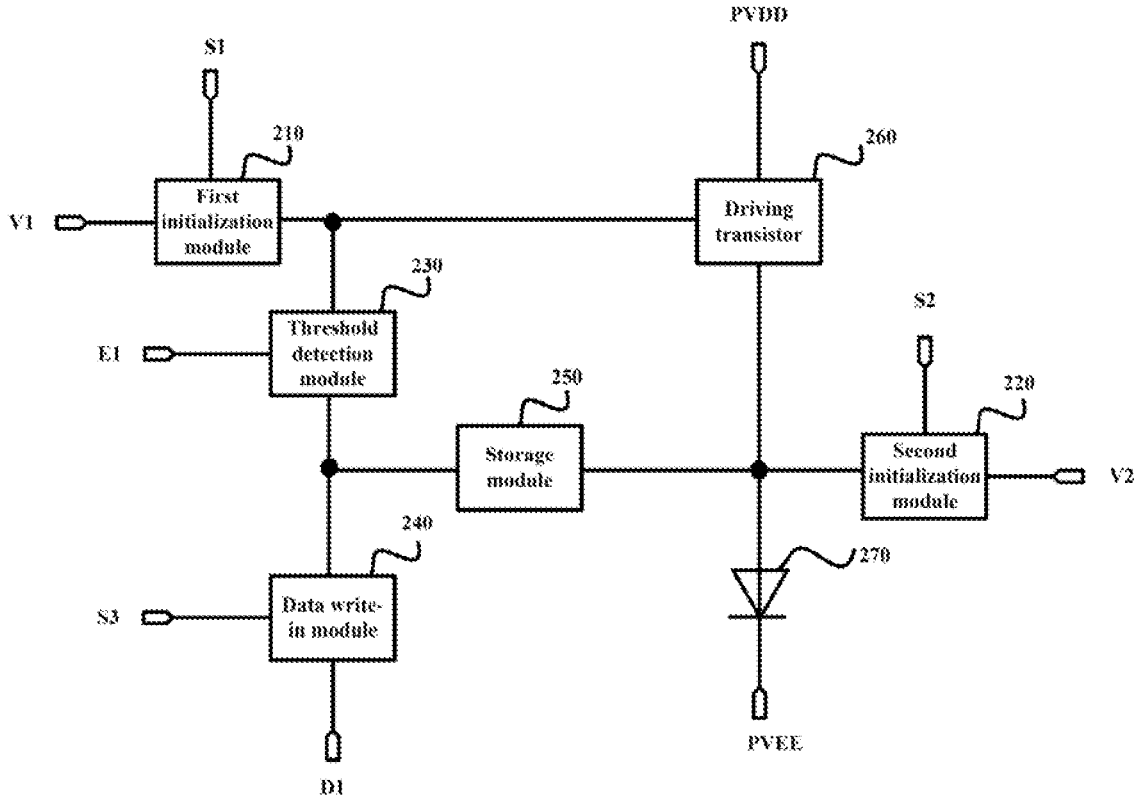
FIG. 2A illustrates a structural schematic view of another exemplary organic light-emitting pixel driving circuit according to embodiments of the present disclosure.

FIG. 2A illustrates a structural schematic view of another exemplary organic light-emitting pixel driving circuit according to embodiments of the present disclosure. As shown in FIG. 2A, similar to that illustrated in FIG. 1A, the organic light-emitting pixel driving circuit may include a first initialization module 210, a second initialization module 220, a threshold detection module 230, a data write-in module 240, a storage module 250, a driving transistor 260, and a light-emitting element 270.

The organic light-emitting pixel driving circuit may further include a reference voltage line V1, an initialization signal line V2, a first scanning signal line S1, a second scanning signal line S2, a third scanning signal line S3, a light-emitting control signal, line E1, and a data line D1. Further, the organic light-emitting pixel driving circuit may include a first power supply voltage end PVDD, and a second power supply voltage end PVEE.

More specifically, the first initialization module 210 may be electrically connected to the reference voltage line V1 and a gate electrode of the driving transistor 260. Based on a signal carried by the first scanning signal line S1, the first initialization module 210 may be turned on. Accordingly, the first initialization module 210 may transmit a signal carried by the reference voltage line V1 to the gate electrode of the driving transistor 260, thereby initializing the driving transistor 260.

The second initialization module 220 may be electrically connected to the initialization signal line V2 and an anode of the light-emitting element 270. Based on a signal carried by the second scanning signal line S2, the second initialization module 120 may be turned on. Accordingly, the second initialization module 220 may transmit a signal carried by the initialization signal line V2 to the anode of the light-emitting element 270, thereby initializing the light-emitting element 270.

Further, the threshold detection module 230 may be electrically connected to a gate electrode of the driving transistor 260, Based on a signal carried by light-emitting control signal line E1, and a threshold voltage Vth of the driving transistor 260 may be detected. The data write-in module 240 may be electrically connected to the data line D1, and be configured to supply a signal (e.g., a data signal voltage) carried by the data line D1 to the pixel driving circuit in response to the third scanning signal line S3.

The storage module 250 may be electrically connected, between the threshold detection module 230 and a source electrode of the driving transistor 260. Further, the storage module 250 may be electrically connected to the data write-in module 240, The storage module 250 may be configured to store the data signal, voltage carried by the data line D1 and compensate the threshold voltage Vth of the driving transistor 260.

As such, when the light-emitting element 270 emits light, the storage module 250 may compensate the threshold voltage of the driving circuit. Accordingly, the stability of the current of the light-emitting element 270 may be ensured, and the display evenness of the organic light-emitting display panel may be improved.

Optionally, in some embodiments, the aforementioned third scanning signal line S3 may be multiplexed as the first scanning signal line S1. Accordingly, the data write-in module 240 may write the data signal into the organic light-emitting pixel driving circuit based on the signal carried by the first scantling signal line S1.

In the aforementioned, organic light-emitting pixel driving circuit, by using the light-emitting control signal line E1 to control the on-and-off of the threshold detection module 230, the threshold voltage Vth of the driving transistor 260 and the signal carried by the data line D1 may be store in the storage module 250. Accordingly, the storage module 250 may compensate the drift of the threshold voltage Vth of the driving transistor 260, and the evenness and stability of the driving current may be ensured, thereby improving the display evenness of the organic light-emitting display panel.

Figure 2B:
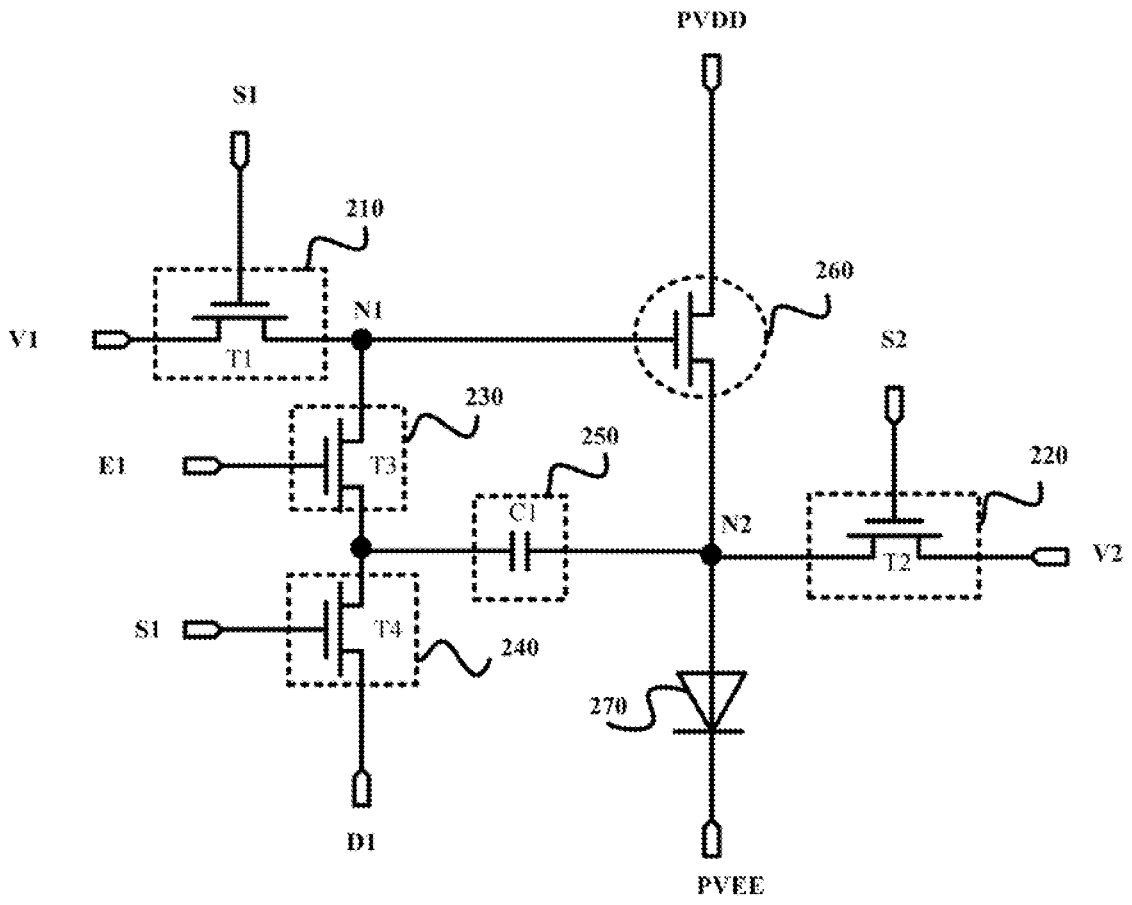
FIG. 2B illustrates an optional implementation of an organic light-emitting pixel driving circuit in FIG. 2A.

FIG. 2B illustrates an example implementation of an organic light-emitting pixel driving circuit in FIG. 2A according to embodiments of the present disclosure. As shown in FIG. 2B, the same as that illustrated in FIG. 2A, the organic light-emitting pixel driving circuit may include a first initialization module 210, a second initialization module 220, a threshold detection module 230, a data write-in module 240, a storage module 250, a driving transistor 260, and a light-emitting element 270.

The organic light-emitting pixel driving circuit may further include a reference voltage line V1, an initialization signal line V2, a first scanning signal line S1, a second scanning signal line S2, a light-emitting control signal line E1, a data line D1, a first power supply voltage end PVDD, and a second power supply voltage end PVEE. In some embodiments, the organic light-emitting pixel driving circuit may further include a third scanning signal line S3. In some other embodiments, the third scanning signal line S3 may be multiplexed as the first scanning signal line S1, that is, the third scanning signal line S3 may no longer be needed.

More specifically, the first initialization module 210 may include a first transistor T1, the second initialization module 220 may include a second transistor T2, the threshold detection module 230 may include a third transistor T3, the data write-in module 240 may include a fourth transistor T4, and the storage module 250 may include a first capacitor C1.

Further, a first electrode of the first transistor T1 may be electrically connected to the reference voltage line V1, a second electrode of the first transistor T1 may be electrically connected to a gate electrode of the driving transistor 260, and a gate electrode of the first transistor T1 may be electrically connected to the first scanning signal line S1.

A first electrode of the second transistor T2 may be electrically connected to the initialization signal line V2, a second electrode of the second transistor T2 may be electrically connected to an anode of the light-emitting element 270, and a gate electrode of the second transistor T2 may be electrically connected to the second scanning signal line S2.

Further, a first electrode of the third transistor T3 may be electrically connected to the gate electrode of the driving transistor 260, a second electrode of the third transistor T3 may be electrically connected to a first plate of the first capacitor C1, and a gate electrode of the third transistor T3 may be electrically connected to the light-emitting control signal line E1. A second plate of the first capacitor C1 may be electrically connected to a source electrode of the driving transistor 260.

Further, a first electrode of the fourth transistor T4 may be electrically connected to the data line D1, and a second electrode of the fourth transistor T4 may be electrically connected to the first plate of the first capacitor C1. In one embodiment, as shown in FIG. 2B, the third scanning signal fine S3 may be multiplexed as the first scanning signal line S1. Thus, a gate electrode of the fourth transistor T4 may be electrically connected to the first scanning signal line S1.

By then, based on a signal carried by the first scanning signal line S1, the data write-in module 240 may be configured to transmit the data voltage signal outputted by the data line D1. In another embodiment, the third, scanning signal line S3 may not be multiplexed as the first scanning signal line S1. That is, the gate electrode of the fourth transistor T4 may be electrically connected to the third scanning signal line S3, instead of the first scanning signal line S1.

Optionally, as shown in FIG. 2B, in some embodiments, the first transistor T1, the second transistor T2, the third, transistor T3, the fourth, transistor T4, and the driving transistor 260 may be all N-type transistors (e.g., NMOS transistors). FIG. 2B only illustrates an exemplary driving circuit, and in practical applications, each of the first transistor T1, the second transistor T2, the third transistor T3, the fourth transistor T4, the fifth transistor T5, and the driving transistor 270 may be configured, to be an N-type transistor (e.g., NMOS transistor) or a P-type transistor (e.g., PMOS transistor).

For example, in an organic light-emitting pixel driving circuit illustrated in FIG. 2B, a gate electrode of the driving transistor 260 may be electrically connected to the first transistor T1, and a source electrode of the driving transistor 260 may be electrically connected to the second transistor T2. The first scanning signal line S1 may be configured to control the first transistor T1 to be turned on, and the second scanning signal line S2 may be configured to control the second transistor T2 to be turned off. Accordingly, the threshold voltage Vth of the driving transistor 260 may be detected.

Figure 2C:
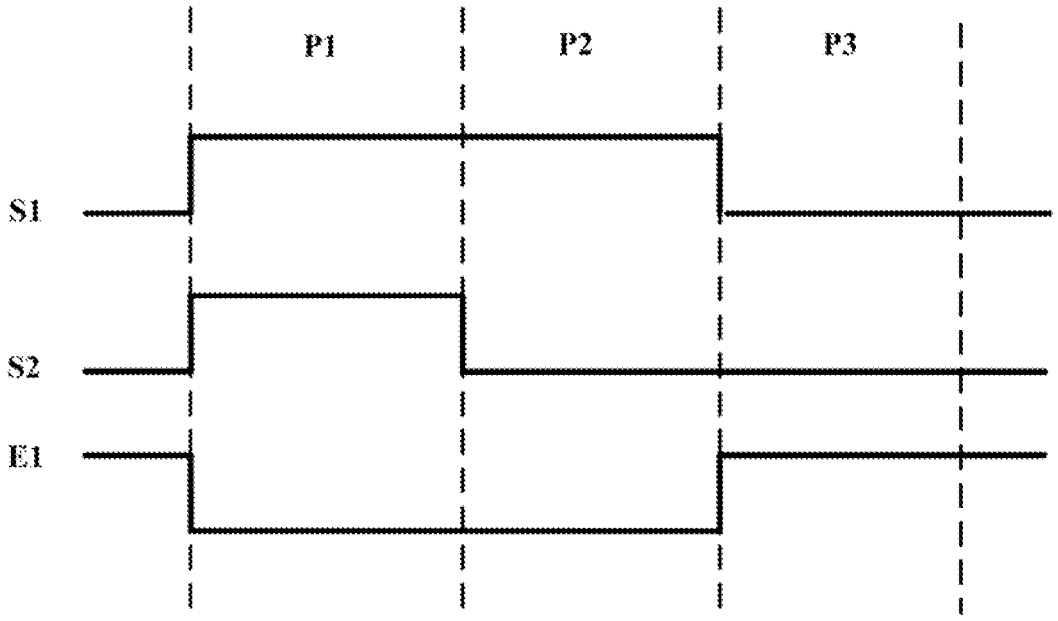
FIG. 2C illustrates an exemplary timing diagram of a timing sequence configured to drive an organic light-emitting pixel driving circuit in FIG. 2B.

Hereinafter, the first transistor T1, the second transistor T2, the third transistor T3, the fourth transistor T4, and the driving transistor 260 are all assumed to be N-type transistors (e.g., NMOS transistors). FIG. 2C illustrates an exemplary timing sequence of an organic light-emitting pixel driving circuit in FIG. 2B according to embodiments of the present disclosure. The working principles of the organic light-emitting pixel driving circuit in FIG. 2B are described hereinafter with reference to FIG. 2C.

As shown in FIG. 2C, the timing sequence of an organic light-emitting pixel driving circuit may include a first stage P1, a second stage P2, and a third stage P3. More specifically, in the first stage P1, a high voltage level signal may be supplied to the first scanning signal line S1 and the second scanning signal line S2, thereby turning on the first transistor T1, the second transistor T2, and the fourth transistor T4. A low voltage level signal may be supplied to the light-emitting control signal line E1, thereby turning off the third transistor T3.

Further, in the first stage P1, a reference voltage Vref may be supplied to the reference voltage line V1, and an initialization signal voltage Vinit may be supplied to the initialization signal line V2. Because the first transistor T1 is turned on, the first transistor T1 may transmit the reference voltage Vref carried by the reference voltage line V1 to the node N1, such that the voltage level of the gate electrode of the driving transistor 260 may be equal to Vref. In particular, the node N1 may be a node intersected by the second electrode of the first transistor T1, the second electrode of the third transistor T3, and the gate electrode of the driving transistor 260.

Further, the second transistor T2 may transmit the initialization signal voltage Vinit carried by the initialization signal line V2 to the node N2, such that the voltage level of the anode of the light-emitting element 270 may be equal to Vinit. The node N2 may be a node intersected by the second electrode of the second transistor T2, the anode of the light-emitting element 270, and the second plate of the first capacitor C1.

In the second stage P2, a high voltage level signal may be supplied to the first scanning signal line S1, thereby turning on the first transistor T1 and the fourth transistor T4. A low voltage level signal may be supplied to the second scanning signal line S2 and the light-emitting control signal line E1, thereby turning off the second transistor T2 and the third transistor T3.

Further, in the second stage P2, the reference voltage Vref may be supplied to the reference voltage line V1, and because the first transistor T1 is turned on, the first transistor T1 may transmit the reference voltage Vref to the node N1. Accordingly, the voltage level of the node N1 may still be equal to Vref. That is, the voltage level Vg of the gate electrode of the driving transistor 260 may be equal to Vref.

Because the second transistor T2 is turned off and the driving transistor 260 is turned on in the first stage P1, the signal carried by the first power supply voltage end PVDD may raise the voltage level at the node N2 from Vinit to Vref−Vth via the driving transistor 260. By then, the voltage level Vs of the source electrode of the driving transistor 260 may be equal to Vref−Vth, where Vth is the threshold voltage of the driving transistor 260.

Further, because the fourth transistor T4 is turned on, the data signal Vdata carried by the data line D1 may be transmitted to the first plate of the first capacitor C1. Further, because the voltage level (i.e., the voltage level of the node N2) of the second plate of the first capacitor C1 is equal to Vref−Vth, the voltage difference between the two plates of the first capacitor C1 may be Vdata−Vref+Vth.

By end of the second stage P2, the voltage level of the node N2 may be equal to Vref−Vth. That is, the voltage level of the anode of the light-emitting element 270 may be equal to Vref−Vth. Because the voltage level of the cathode of the light-emitting element 270 is the second power supply voltage PVEE outputted by the second voltage supply voltage end PVEE, the voltage difference between the anode and the cathode of the light-emitting element 270 may be Vref−Vth−PVEE. Further, in the second stage, Vref−Vth−PVEE may be smaller than the threshold voltage Voled of the light-emitting element 270, such that the light-emitting element 270 may not emit light.

In the third stage P3, a high voltage level signal may be supplied to the light-emitting control signal line E1, thereby turning on the third transistor T3. A low voltage level signal may be supplied to the first scanning signal line S1 and the second scanning signal line S2, thereby turning off the first transistor T1, the second transistor T2, and the fourth transistor T4. Because the third transistor T3 is turned on, two plates of the first capacitor C1 may be electrically connected between the gate electrode and the source electrode of the driving transistor 260.

In the third stage P3, the driving transistor 260 may be turned on, and the voltage level at the node N2 may be raised from Vref−Vth to PVEE+Voled, such that the light-emitting element 270 may emit light. By then, the voltage level of the anode of the light-emitting element 270 may be equal to PVEE+Voled. That is, the voltage level Vs of the source electrode of the driving transistor 260 may be equal to PVEE+Voled.

When the second stage P2 ends, the voltage difference between the two plates of the first capacitor C1 may be equal to Vdata−Vref+Vth. Because of the bootstrap function of the first capacitor C1, the voltage difference between the two plates of the first capacitor C1 may remain unchanged. When the variance in the voltage level of the first plate of the first capacitor C1 is equal to PVEE+Voled−Vref+Vth, the voltage level of the first plate of the first capacitor C1 may vary by Vdata−(PVEE+Voled−Vref+Vth). That is, the voltage level Vg of the gate electrode of the driving transistor 260 may be equal to PVEE+Voled+Vdata−Vref+Vth.

According to the equation of the driving current generated by the light-emitting element 270, the driving current Ioled that flows through the driving transistor 260 and is configured to drive the light-emitting element 270 to emit light may be proportional to the square of the difference between the gate-source voltage Vgs and the threshold voltage Vth of the driving transistor 260. The gate-source voltage Vgs may be a voltage difference between the gate electrode and the source electrode of the driving transistor 260. That is, the gate-source voltage Vgs of the driving transistor 260 may be a voltage between the node N1 and the node N2. Accordingly, the driving current of the light-emitting element 260 may be:

$$Ioled \propto (Vgs-Vth)^2=(Vg-Vs-Vth)^2=((PVEE+Voled+Vdata-Vref+Vth)-(PVEE+Voled)-Vth)^2=(Vdata-Vref)^2.$$

From the equation above, the driving current Ioled of the light-emitting element 270 may not be related to the threshold voltage Vth of the driving transistor 260, and the compensation for the threshold voltage of the driving transistor 260 may be realized.

As such, when the disclosed organic light-emitting pixel driving circuit is applied to the organic light-emitting display panel, because the fight-emitting current is not related to the threshold voltage Vth of the driving transistor 260, the phenomenon such as uneven display caused by threshold difference of the driving transistors 260 may not occur. Accordingly, the display evenness of the display panel may be improved.

Figure 3:
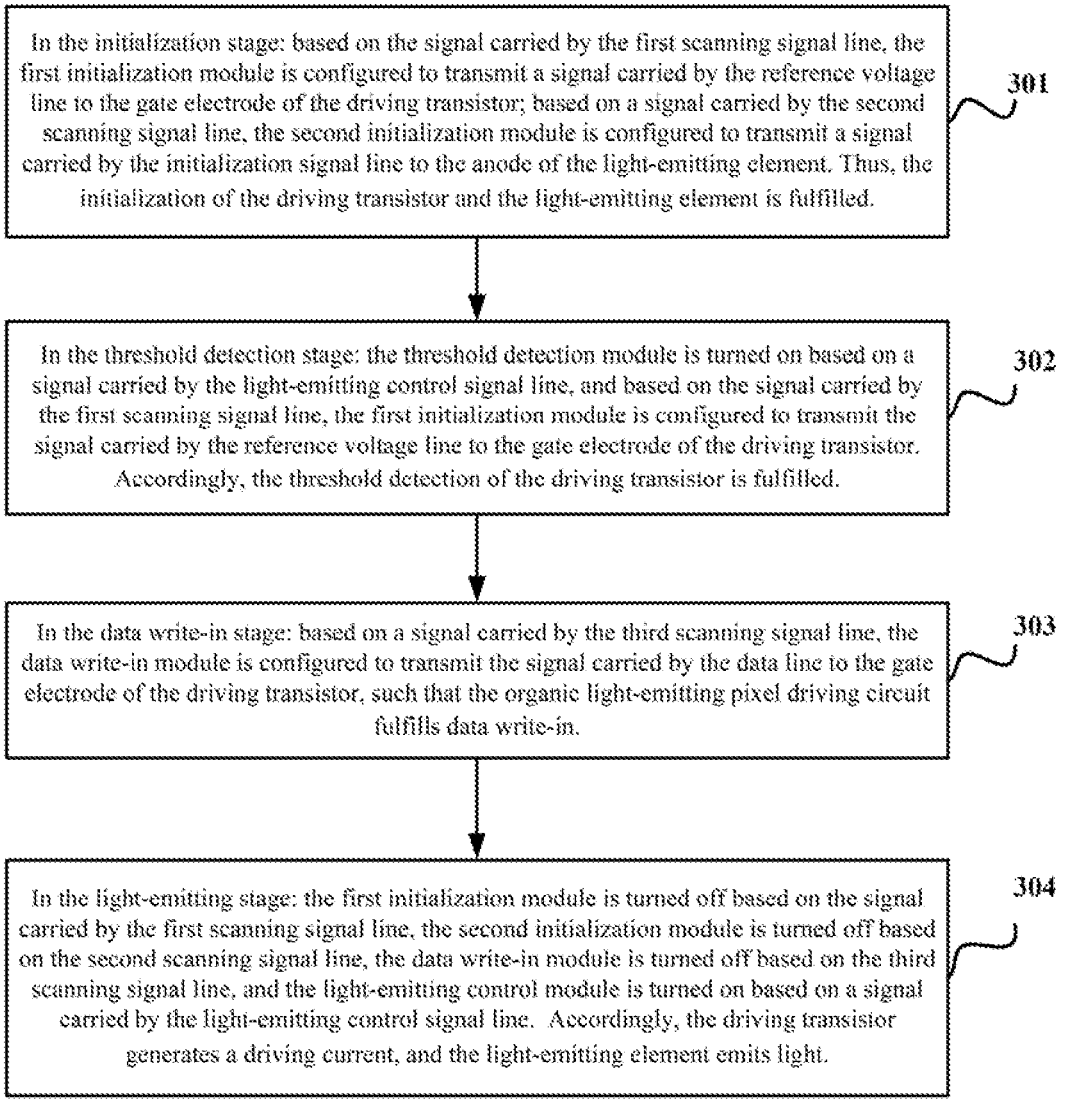
FIG. 3 illustrates an exemplary flow chart of a driving method for driving an organic light-emitting pixel driving circuit in FIG. 1A or FIG. 1B.

FIG. 3 illustrates a flow chart of an exemplary driving method for driving an organic light-emitting pixel driving circuit in FIG. 1A or FIG. 1B according to embodiments of the present disclosure. More specifically, as shown in FIG. 3, a flow chart of a driving method for an organic light-emitting pixel driving circuit in one frame period is provided. Further, the disclosed driving method of the organic light-emitting pixel driving circuit may be configured to drive the organic light-emitting pixel driving circuit illustrated in FIG. 1A or FIG. 1B.

As shown in FIG. 1A or FIG. 1B, the driving circuit may optionally include a light-emitting control module 180. Further, referring to FIG. 3, the driving method of the organic light-emitting pixel driving circuit may specifically include the following steps (Step 301~Step 304).

Step 301: In the initialization stage, based on the signal carried by the first scanning signal line, the first initialization module may be configured to transmit a signal carried by the reference voltage line to the gate electrode of the driving transistor. Simultaneously, based on a signal carried by the second scanning signal line, the second initialization module may be configured to transmit, a signal carried by the initialization signal line to the anode of the light-emitting element. Accordingly, the initialization of the driving transistor and the light-emitting element may be fulfilled.

Step 302: In the threshold detection stage, the threshold detection module may be turned on based on a signal carried by the light-emitting control signal line, and based on the signal carried by the first scanning signal line, the first initialization module may be configured to transmit the signal carried by the reference voltage line to the gate electrode of the driving transistor. Accordingly, the threshold detection of the driving transistor may be fulfilled.

Step 303: In the data write-in stage, based on a signal carried by the third scanning signal line, the data write-in module may be configured to transmit the signal carried by the data line to the gate electrode of the driving transistor, such that the organic light-emitting pixel driving circuit may fulfill data, write-in.

Step 304: In the light-emitting stage, the first initialization module may be turned off based on the signal carried by the first scanning signal line, and the second initialization module may be turned off based on the second scanning signal line, and the data write-in module may be turned off based on the third scanning signal line. Further, the light-emitting control module may be turned on based on a signal carried by the light-emitting control signal line. Accordingly, the driving transistor may generate a driving current, and the light-emitting element may emit light.

More specifically, when the aforementioned driving method is configured to drive the organic light-emitting pixel driving circuit illustrated in FIG. 1B, the working processes of the initialization stage, the threshold detection stage, the data write-in stage, and the light-emitting stage may be illustrated in detail as follows.

In the initialization stage, under the control of the first scanning signal, line S1, the first transistor T1 may be configured to transmit the reference voltage Vref carried by the reference voltage line V1 to the gate electrode of the driving transistor 160. Further, under the control of the second scanning signal line S2, the second transistor T2 may be configured to output the initialization voltage Vinit to the anode of the light-emitting element 170, Accordingly, the initialization of the driving transistor 160 and the light-emitting element 170 may be fulfilled.

In the threshold, detection stage, under the control of the first scanning signal line S1, the first transistor T1 may be configured to transmit the reference voltage Vref carried by the reference voltage line V1 to the gate electrode of the driving transistor 160. Further, the third transistor T3 may be turned on under the control of the light-emitting control signal line E1, thereby coupling the first capacitor C1 between the source electrode and the gate electrode of the driving transistor 160. Through the coupling effect of the first capacitor C1, the threshold detection of the driving transistor 160 may be fulfilled.

In the data write-in stage, under the control of the third scanning signal line S3, the fourth transistor T4 may be configured to transmit the data signal voltage carried by the data line D1 to the gate electrode of the driving transistor 160. Accordingly, the organic light-emitting pixel driving circuit may fulfill data write-in.

In the light-emitting stage, the first transistor T1 may be turned, off under the control of the first scanning signal line S1, the second transistor T2 may be turned off under the control of the second scanning signal line S2, and the fourth transistor T4 may be turned off under the control of the third scanning signal line S2. Further, the fifth transistor T5 may be turned on under the effect of the light-emitting control signal line E1. Accordingly, the driving transistor 160 may generate a driving current, and the light-emitting element 170 may emit light.

Optionally, the signal carried by the first scanning signal line S1 that turns on the first initialization module (i.e., the first transistor T1) may be delayed for a preset period of time with respect to the signal carried by the third scanning signal line S3 that turns on the data write-in module (i.e., the fourth transistor T4). Further, as shown in FIG. 1C, the signal carried by the third scanning signal line S3 may be a phase-reversed signal with respect to the signal carried by the light-emitting control signal line E1.

Further, in the disclosed driving method, in the threshold detection stage, the voltage difference between the voltage level of the anode of the light-emitting element 170 and the voltage level of the second power supply voltage end PVEE may be lower than the threshold voltage that turns on the light-emitting element 170. Accordingly, the light-emitting element 170 may not emit light in the threshold detection stage.

Figure 4:
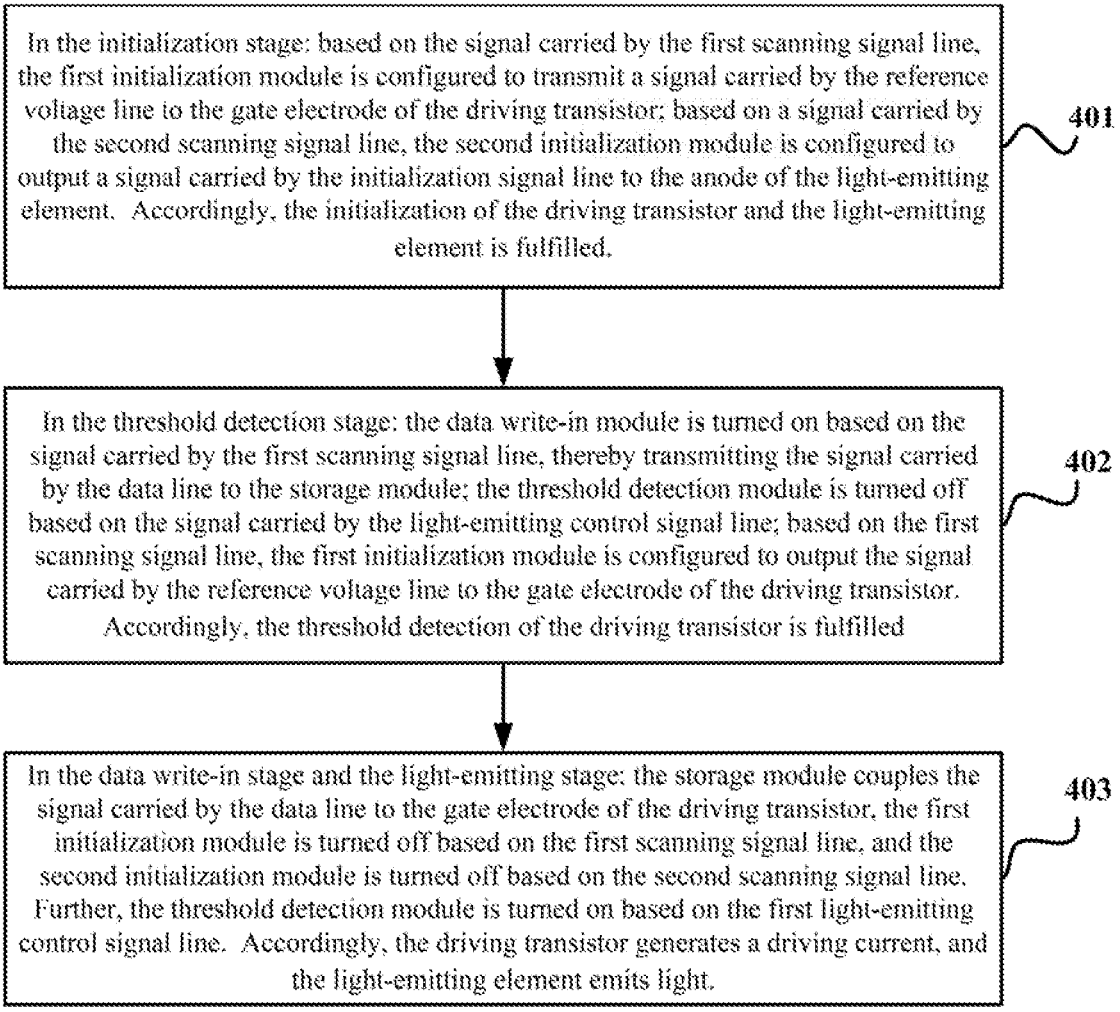
FIG. 4 illustrates an exemplary flow chart of a driving method, for driving an organic light-emitting pixel driving circuit in FIG. 2A or FIG. 2B.

FIG. 4 illustrates a flow chart of an exemplary driving method for driving an organic light-emitting pixel driving circuit in FIG. 2A or FIG. 2B according to embodiments of the present disclosure. More specifically, as shown in FIG. 4, a flow chart of a driving method for an organic light-emitting pixel driving circuit in one frame period is provided. Further, the driving method of the organic light-emitting pixel driving circuit may be configured to drive the organic light-emitting pixel driving circuit illustrated in FIG. 2A or FIG. 2B.

Optionally, as shown in FIG. 2A or FIG. 2B, because the first scanning signal line S1 may be multiplexed as the third scanning signal line S3, the scanning signal line S3 may be no longer included in the disclosed organic light-emitting pixel driving circuit. Thus, referring to FIG. 4, the driving method of the organic light-emitting pixel driving circuit illustrated in FIG. 2A or FIG. 2B may specifically include the following steps (Step 401~Step 403).

Step 401: In the initialization stage, based, on the signal carried by the first scanning signal line, the first initialization module may be configured to transmit a signal carried by the reference voltage line to the gate electrode of the driving transistor. Further, based on a signal carried by the second scanning signal line, the second initialization module may be configured to output a signal, carried, by the initialization signal line to the anode of the light-emitting element. Accordingly, the initialization of the driving transistor and the light-emitting element may be fulfilled.

Step 402: In the threshold detection stage, the data, write-in module may be turned on based on the signal carried by the first scanning signal line, thereby transmitting the signal carried by the data line to the storage module. Further, the threshold detection module may be turned off based on the signal carried by the light-emitting control signal line. Further, based on the first scanning signal line, the first initialization module may be configured to output the signal carried by the reference voltage line to the gate electrode of the driving transistor. Accordingly, the threshold detection of the driving transistor may be fulfilled.

Step 403: In the data write-in stage and the light-emitting stage, the storage module may couple the signal carried by the data line to the gate electrode of the driving transistor. Further, the first initialization module may be turned off based on the first scanning signal line, and the second initialization, module may be turned off based on the second scanning signal line. Further, the threshold detection module may be turned on based on the first light-emitting control signal line. Accordingly, the driving transistor may generate a driving current, and the light-emitting element may emit light.

More specifically, when the aforementioned driving method is configured to drive the organic light-emitting pixel driving circuit illustrated in FIG. 2B, the working processes of the initialization stage, the threshold detection stage, the data write-in stage, and the light-emitting stage may be illustrated in detail as follows.

In the initialization stage, under the control of the first scanning signal line S1, the first transistor T1 may be configured to transmit the reference voltage Vref carried by the reference voltage line V1 to the gate electrode of the driving transistor 260. Further, under the control of the second scanning signal line S2, the second transistor T2 may be configured to transmit the initialization voltage Vinit to the anode of the light-emitting element 270. Accordingly, the initialization of the driving transistor 260 and the light-emitting element 270 may be fulfilled.

In the threshold detection stage, under the control of the first scanning signal line S1, the fourth transistor T4 may be configured to transmit the data signal Vdata carried by the data line D1 to the first capacitor C1, and the third transistor T3 may be turned off under the control of the light-emitting control signal, line E1, and under the control of the first scanning signal line S1. Further, the first transistor T1 may be configured, to transmit the reference voltage Vref carried by the reference voltage V1 to the gate electrode of the driving transistor 260. Accordingly, the threshold detection of the driving transistor 260 may be fulfilled.

In the data write-in stage and the light-emitting stage, the first capacitor C1 may be configured to couple the data signal Vdata carried by the data line D1 to the gate electrode of the driving transistor 260. Further, the third transistor T3 may be turned on under the control of the light-emitting control signal line E1, thereby electrically connecting the first capacitor C1 between the gate electrode and the source electrode of the driving transistor 260. Further, the driving transistor 260 may be turned on to generate the driving current, and the light-emitting element 270 may emit light.

Further, in the aforementioned threshold detection stage, the voltage difference between the voltage level of the anode of the light-emitting element 270 and the voltage level of the second power supply voltage end PVEE may be lower than the threshold voltage that turns on the light-emitting element 270. Accordingly, the light-emitting element 270 may not emit light in the threshold, detection stage.

Figure 5:
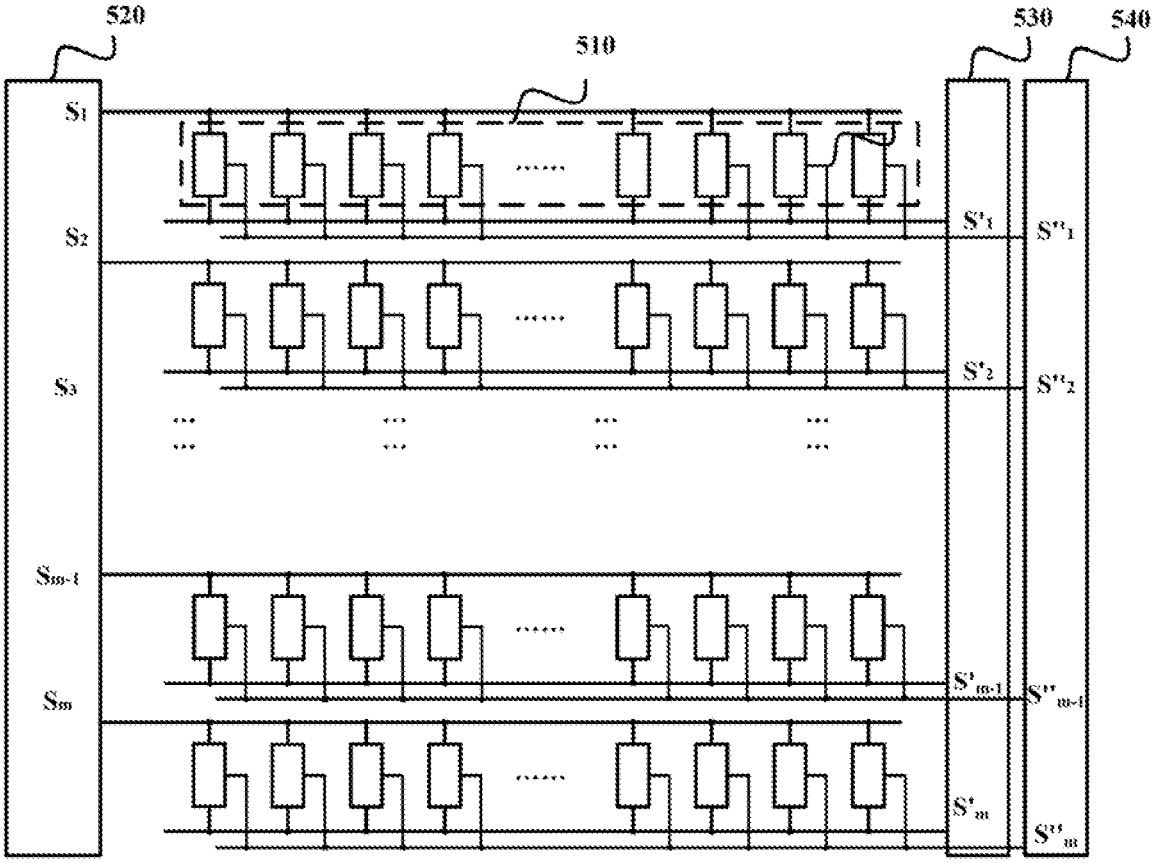
FIG. 5 illustrates a structural schematic view of an exemplary organic light-emitting display panel according to embodiments of the present disclosure.

FIG. 5 illustrates a structural schematic view of an exemplary organic light-emitting display panel according to embodiments of the present disclosure. As shown in FIG. 5, the organic light-emitting display panel may include a plurality of rows of pixel units 510. A pixel unit in the plurality of rows of pixel units 510 may include an organic light-emitting pixel driving circuit.

For example, the organic light-emitting pixel driving circuit may refer to an organic light-emitting pixel driving circuit illustrated in FIG. 1A or FIG. 1B. As shown in FIG. 1A or FIG. 1B, the organic light-emitting pixel driving circuit may include a light-emitting control module electrically connected to a driving transistor. The light-emitting control module may be configured to transmit the signal carried by a first power supply voltage end to the driving transistor based on a light-emitting control signal.

Further, each row of pixel units in the organic light-emitting display panel may be electrically connected to one first scanning signal line ($S_1$, $S_2$, . . . , or $S_m$), one second scanning signal line ($S'_1$, $S'_2$, . . . , or $S'_m$), and one third scanning signal line ($S''_1$, $S''_2$, . . . , or $S''_m$). In one embodiment, as shown in FIG. 5, an $(m-1)^{th}$ row of pixel units may be electrically connected to a first scanning signal line $S_{m-1}$, a second scanning signal line $S'_{m-1}$, and a third scanning signal line $S''_{m-1}$, where m is a positive integer greater than 1. For example, the first row of pixel units may be electrically connected to a first scanning signal line $S_1$, a second scanning signal line $S'_1$, and a third scanning signal line $S''_1$.

Further, signals carried by the first scanning signal lines $S_1$~$S_m$, signals carried by the second scanning signal lines $S'_1$~$S'_m$, and signals carried by the second scanning signal lines $S''_1$~$S''_m$ may be generated by three shift registers 520, 530 and 540, respectively. For example, the signals carried by the first scanning signal lines $S_1$~$S_m$ may be generated, by the shift register 520. The signals carried by the second scanning signal lines $S'_1$~$S'_m$ may be generated by the shift register 530. The signals carried by the third scanning signal lines $S''_1$~$S''_m$ may be generated by the shift register 540.

Further, the signals carried by the first scanning signal lines $S_1$~$S_m$ may have the same waveform as the waveform of the signal outputted by the first scanning signal line S1 in FIG. 1C. The signals carried by the second scanning signal lines $S'_1$~$S'_m$ may have the same waveform as the waveform of the signal outputted by the second scanning signal line S2 in FIG. 1C. The signals carried by the second scanning signal lines $S''_1$~$S''_m$ may have the same waveform as the waveform of the signal outputted by the third scanning signal line S3 in FIG. 1C.

Optionally, the organic light-emitting pixel driving circuit included in a pixel unit of the plurality of rows of pixel units 510 may refer to a driving circuit illustrated in FIG. 2A or FIG. 2B. As shown in FIG. 2A or FIG. 2B, the first scanning signal line S1 may be multiplexed as the third scanning signal line S3. Thus, each row of pixel, units in the organic light-emitting display panel may be connected to one first scanning signal line and one second scanning signal line.

In the disclosed organic light-emitting display panel, by using the aforementioned organic light-emitting pixel driving circuit the threshold voltage compensation of the driving transistor may be implemented. Accordingly, the brightness evenness of the organic light-emitting display panel may be improved. Further, the aforementioned organic light-emitting pixel driving circuit may avoid an issue of the existence of voltage attenuation in the first power supply voltage corresponding to different rows of pixel units in the display panel. Further, because only one capacitor is included in the organic light-emitting pixel driving circuit, the layout area of the pixel circuit in the display panel may be relatively small, thereby facilitating the fabrication of high PPI display panels.

Figure 6:
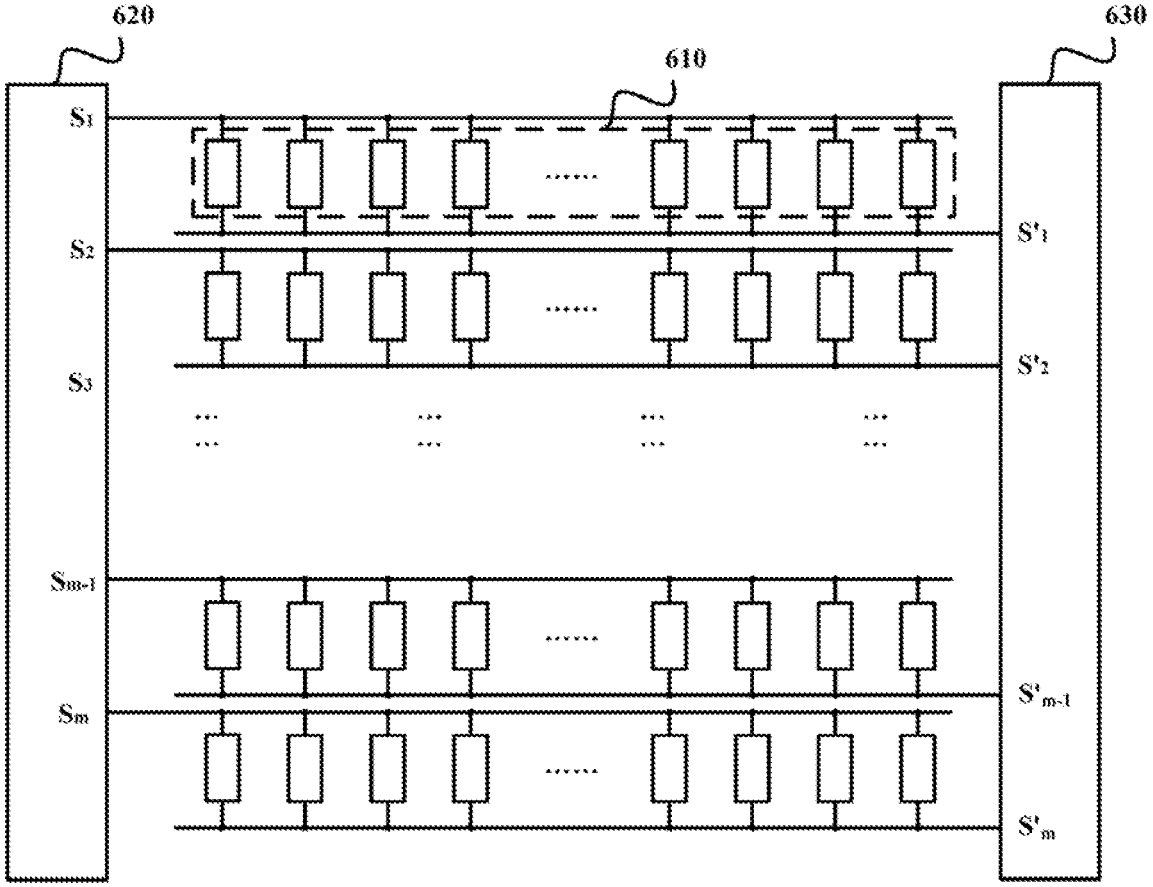
FIG. 6 illustrates a structural schematic view of another exemplary organic light-emitting display panel according to embodiments of the present disclosure.

FIG. 6 illustrates a structural schematic view of another exemplary organic light-emitting display panel according to embodiments of the present disclosure. As shown in FIG. 6, the organic light-emitting display panel may include a plurality of rows of pixel units 610. A pixel unit in the plurality of rows of pixel units 610 may include an organic light-emitting pixel driving circuit.

Optionally, for example, a pixel unit in the plurality of rows of pixel units 610 may include an organic light-emitting pixel driving circuit illustrated in FIG. 1A or FIG. 1B. Each row of pixel units 610 in the organic light-emitting display panel may be electrically to one first scanning signal line, one second scanning signal line, and one third scanning signal line.

Optionally, a pixel unit in the plurality of rows of pixel units 610 may include an organic light-emitting pixel driving circuit illustrated in FIG. 2A or FIG. 2B. Because a first scanning signal line may be multiplexed as a third, scanning signal fine, each row of pixel units 610 in the organic light-emitting display panel may be electrically to one first scanning signal line, and one second scanning signal line. That is, the third scanning signal line may be no longer needed.

In one embodiment, the organic light-emitting pixel driving circuit included in the organic light-emitting display panel may refer FIG. 1A or FIG. 1B. Each organic light-emitting pixel driving circuit may include one first scanning signal line, one second scanning signal line, and one third scanning signal line. Further, optionally, a third scanning signal line connected to an $i^{th}$ row of pixel units may be multiplexed as a first scanning signal line connected to an $(i+1)^{th}$ row of pixel units, where i is a positive integer.

More specifically, referring to FIG. 5 and FIG. 6, the third scanning signal line connected to the first row of pixel units may be multiplexed as the first scanning signal line connected to the second row of pixel units. As such, the first scanning signal and the third scanning signal needed in each organic light-emitting pixel driving circuit may be generated by the same shift register 620. Accordingly, the layout area occupied by the circuit in the organic light-emitting display panel may be further reduced.

Further, each organic light-emitting pixel driving circuit in the disclosed organic light-emitting display panel may be driven using a timing sequence illustrated in FIG. 1C. As shown in the timing sequence illustrated in FIG. 1C, the control signal supplied to the light-emitting control signal line E1 in the organic light-emitting pixel driving circuit corresponding to each pixel unit may be obtained by reversing the phase of the signal supplied to the third scanning signal line.

The shift register in the organic light-emitting display panel, configured to generate the signal carried by the third scanning signal line may include two signal output ends. One of the two signal output ends may be electrically connected to the third scanning signal line, and the other one of the two signal output ends may be electrically connected to the light-emitting control signal, line via a phase-reversing module. Accordingly, the third scanning signal and the light-emitting control signal illustrated in FIG. 1C may be obtained. Further, the layout area of the driving circuit in the aforementioned organic light-emitting display panel occupying the organic light-emitting display panel may be further reduced.

Optionally, when an organic light-emitting pixel driving circuit illustrated in FIG. 2A or FIG. 2B is used in the disclosed organic light-emitting display panel, a timing sequence in FIG. 2C may be configured to drive the organic light-emitting pixel driving circuit in the organic light-emitting display panel. Similarly, as shown in FIG. 2C, the signal outputted by the first scanning signal line may be a phase-reversed signal with respect to the signal outputted by the light-emitting control signal line.

Further, the shift register in the organic light-emitting display panel configured to generate the signal carried, by the first scanning signal line may also include two signal, output ends. One of the two signal output ends may be electrically connected to the first scanning signal line, and the other one of the two signal output ends may be electrically connected to the light-emitting control signal line via a phase-reversing module. By then, the first scanning signal and the light-emitting control signal illustrated in FIG. 2C may be obtained. Accordingly, the layout area occupied by the driving circuit in the organic light-emitting display panel may be further reduced.

It should be noted that, the above detailed descriptions illustrate only preferred, embodiments of the present disclosure and technologies and principles applied herein. Those skilled in the art can understand that the present disclosure is not limited to the specific embodiments described herein, and numerous significant alterations, modifications and alternatives may be devised by those skilled in the art without departing from the scope of the present disclosure. Thus, although the present disclosure has been illustrated in above-described embodiments in details, the present disclosure is not limited to the above embodiments. Any equivalent or modification thereof, without departing from the spirit and principle of the present invention, falls within the true scope of the present invention, and the scope of the present disclosure is defined by the appended claims.

What is claimed is:

1. An organic light-emitting pixel driving circuit, comprising:

a light-emitting element, a driving transistor, configured to drive the light-emitting element to emit light, a first initialization module including a first transistor, configured to transmit a signal carried by a reference voltage line to a gate electrode of the driving transistor under control of a first signal carried by a first scanning signal line and a first electrode of the first transistor is connected to the reference voltage line, a second electrode of the first transistor is directly connected to the gate electrode of the driving transistor, and a gate electrode of the first transistor is connected to the first scanning signal line, a second initialization module including a second transistor under control of a second signal carried by a second scanning signal line, wherein the second initialization module is configured to transmit a signal carried by an initialization signal line to an anode of the light-emitting element to initiate the anode of the light-emitting element, and the second signal is different from the first signal, a threshold detection module including a third transistor, configured to detect a threshold voltage of the driving transistor under control of a light-emitting control signal line, a data write-in module including a fourth transistor, configured to transmit a signal carried by a data line to the pixel driving circuit under control of a third scanning signal line, wherein the data write-in module is further configured, in a data write-in stage, to transmit a signal carried by a data line to the gate electrode of the driving transistor based on the third scanning signal line, such that data write-in of the organic light-emitting pixel driving circuit is fulfilled, and a storage module including a first capacitor and connected between the third transistor in the threshold detection module and a source electrode of the driving transistor, and configured to store a signal written in by the data line, wherein:

a first electrode of the third transistor is directly connected to the gate electrode of the driving transistor, a second electrode of the third transistor is connected only to a first plate of the first capacitor, a second plate of the first capacitor is directly connected to the source electrode of the driving transistor, a second electrode of the fourth transistor in the data write-in module is directly connected to the gate electrode of the driving transistor, and in a light-emitting stage, the first initialization module is turned off to have the first transistor in an off-state based on the first scanning signal line, the second initialization module is turned off to have the second transistor in an off-state based on the second scanning signal line, the data write-in module is turned off to have the fourth transistor in an off-state based on the third scanning signal line, and the light-emitting control module is turned on to have a fifth transistor in an on-state based on the light-emitting control signal line, such that the driving transistor generates a driving current and the light-emitting element emits light.

2. The driving circuit according to claim 1, wherein:

a first electrode of the second transistor is connected to the initialization signal line, a second electrode of the second transistor is connected to the anode of the light-emitting element, and a gate electrode of the second transistor is connected to the second scanning signal line, and a gate electrode of the third transistor is connected to the light-emitting control signal line.

3. The driving circuit according to claim 2, further comprising:

a light-emitting control module connected to the driving transistor, wherein the light-emitting control module includes the fifth transistor and is configured to transmit a signal carried by a first power supply voltage end to the driving transistor under control of the light-emitting control signal line.

4. The driving circuit according to claim 3, wherein:

a first electrode of the fourth transistor is connected to the data line, a second electrode of the fourth transistor is connected to the gate electrode of the driving transistor, and a gate electrode of the fourth transistor is connected to the third scanning signal line, and a first electrode of the fifth transistor is connected to the first power supply voltage end, a second electrode of the fifth transistor is connected to a drain electrode of the driving transistor, and a gate electrode of the fifth transistor is connected to the light-emitting control signal line.

5. The driving circuit according to claim 2, wherein:

the first scanning signal line is multiplexed as the third scanning signal line, and a first electrode of the fourth transistor is connected to the data line, a second electrode of the fourth transistor is connected to the first plate of the first capacitor, and a gate electrode of the fourth transistor is connected to the first scanning signal line.

6. The driving circuit according to claim 5, wherein:

the first transistor, the second transistor, the third transistor, the fourth transistor, the fifth transistor, and the driving transistor are all N-type transistors or all P-type transistors.

7. An organic light-emitting display panel comprising a plurality of rows of pixel units, wherein a row of pixel units includes a plurality of organic light-emitting pixel driving circuits according to claim 1.

8. The display panel according to claim 7, wherein:

the row of pixel units is connected to a first scanning signal line, a second scanning signal line, and a third scanning signal line.

9. The display panel according to claim 8, wherein:

the row of pixel units is connected to a light-emitting control signal line, and a signal outputted by the light-emitting control signal line is obtained by reversing phase of a signal outputted by an output unit connected to the third scanning signal line using a phase-reversing circuit.

10. The display panel according to claim 8, wherein:

an organic light-emitting pixel driving circuit further includes a light-emitting control module connected to a corresponding driving transistor, the light-emitting control module is configured to transmit a signal outputted by a first power supply voltage end to the driving transistor based on a light-emitting control signal line, and a third scanning signal line connected to an $i^{th}$ row of pixel units is multiplexed as a first scanning signal line connected to an $(i+1)^{th}$ row of pixel units, where i is a positive integer.

11. A driving method of an organic light-emitting pixel driving circuit, wherein the organic light-emitting pixel driving circuit includes a first initialization module including a first transistor, a second initialization module including a second transistor, a threshold detection module including a third transistor, a data write-in module including a fourth transistor, a driving transistor, a light-emitting element, and a light-emitting control module including a fifth transistor, wherein a first electrode of the first transistor is connected to a reference voltage line, a second electrode of the first transistor is directly connected to a gate electrode of the driving transistor, a gate electrode of the first transistor is connected to a first scanning signal line, a first electrode of the third transistor is directly connected to the gate electrode of the driving transistor, a second electrode of the third transistor is connected only to a first plate of the first capacitor, a second plate of the first capacitor is directly connected to a source electrode of the driving transistor, and a second electrode of the fourth transistor in the data write-in module is directly connected to the gate electrode of the driving transistor, the driving method comprising:

in an initialization stage, transmitting, by the first initialization module, a signal carried by the reference voltage line to the gate electrode of the driving transistor based on the first scanning signal line, and transmitting, by the second initialization module, a signal carried by an initialization signal line to an anode of the light-emitting element based on a second scanning line, such that initialization of the driving transistor and the light-emitting element is fulfilled, in a threshold detection stage, turning on the threshold detection module to have the third transistor in an on-state, based on a signal carried by a light-emitting control signal line, and transmitting, by the first initialization module, a signal carried by the reference voltage line to the gate electrode of the driving transistor based on the first scanning signal line, such that threshold detection of the driving transistor is fulfilled, in a data write-in stage, transmitting, by the data write-in module, a signal carried by a data line to the gate electrode of the driving transistor based on a third scanning signal line, such that data write-in of the organic light-emitting pixel driving circuit is fulfilled, and in a light-emitting stage, turning off the first initialization module to have the first transistor in an off-state based on the first scanning signal line, turning off the second initialization module to have the second transistor in an off-state based on the second scanning signal line, turning off the data write-in module to have the fourth transistor in an off-state based on the third scanning signal line, and turning on the light-emitting control module to have the fifth transistor in an on-state based on the light-emitting control signal line, such that the driving transistor generates a driving current and the light-emitting element emits light.

12. The driving method according to claim 11, wherein:

the signal carried by the third scanning signal line and a signal carried by the light-emitting control signal line are phase-reversed signals.

13. A driving method of an organic light-emitting pixel driving circuit, wherein the organic light-emitting pixel driving circuit includes a first initialization module including a first transistor, a second initialization module including a second transistor, a threshold detection module including a third transistor, a data write-in module including a fourth transistor, a driving transistor, a storage module and a light-emitting element, the driving method further comprising:

in an initialization stage, transmitting, by the first initialization module, a signal carried by a reference voltage line to a gate electrode of the driving transistor based on a first scanning signal line, and transmitting, by the second initialization module, a signal carried by an initialization signal line to an anode of the light-emitting element based on a second scanning line, such that initialization of the driving transistor and the light-emitting element is fulfilled, and in a threshold detection stage, turning on the data write-in module to have the fourth transistor in an on-state based on the first scanning signal line to transmit a signal carried by a data line to the storage module, turning off the threshold detection module to have the third transistor in an off-state based on a light-emitting control signal line, and transmitting, by the first initialization module, a signal carried by reference voltage line to the gate electrode of the driving transistor based on the first scanning signal line, such that threshold detection of the driving transistor is fulfilled, wherein in the threshold detection stage, a voltage difference between a voltage level of the anode of the light-emitting element and a voltage level of a second power supply voltage end connected to the light-emitting element is smaller than a threshold voltage that turns on the light-emitting element, and the light-emitting element emits no light, the voltage level of the anode of the light-emitting element equaling to a reference voltage supplied to a reference voltage line connected to the first transistor minus a threshold voltage of the driving transistor.

14. The driving method according to claim 13, further comprising:

in a data write-in and light-emitting stage, coupling the signal carried by the data line, by the storage module, to the gate electrode of the driving transistor, turning off the first initialization module to have the first transistor in an off-state based on the first scanning signal line, turning off the second initialization module to have the second transistor in an off-state based on a second scanning signal line, and turning on the threshold detection module to have the third transistor in an on-state, based on the first light-emitting control signal line, such that the driving transistor drives the light-emitting element to emit light.

* * * * *